United States Patent [19]

Daudi et al.

[11] 4,279,287

[45] Jul. 21, 1981

[54] METHOD OF WHEEL MANUFACTURE FOR CORRECTING ROTATIONAL NON-UNIFORMITY OF A PNEUMATIC TIRE AND WHEEL ASSEMBLY

[75] Inventors: Anwar Daudi, East Lansing; John H. Golata, Lansing; Doarde G. Triponi, East Lansing, all of Mich.

[73] Assignee: Motor Wheel Corporation, Lansing, Mich.

[21] Appl. No.: 104,319

[22] Filed: Dec. 17, 1979

[51] Int. Cl.[3] ..... B21D 53/26

[52] U.S. Cl. ..... 152/375; 29/159 R; 29/159.01; 29/407

[58] Field of Search ..... 29/159 R, 159.01, 407; 152/375; 301/5 B, 1

[56] References Cited

U.S. PATENT DOCUMENTS

| | | | |
|---|---|---|---|
| 276,292 | 4/1883 | Seymour . | |
| 1,479,482 | 1/1924 | Prescott et al. . | |
| 1,860,216 | 5/1932 | Ash . | |
| 2,708,119 | 5/1955 | Best | 280/47.21 |
| 3,046,058 | 7/1962 | Hamer | 301/5 B |
| 3,207,557 | 9/1965 | Hunter | 301/5 B |
| 3,461,710 | 8/1969 | Luedi et al. | 72/372 |
| 3,581,550 | 6/1971 | Waterbury | 72/402 |
| 3,808,660 | 5/1974 | Wik | 29/159 R |
| 3,951,563 | 4/1976 | Ravenhall | 408/1 R |

FOREIGN PATENT DOCUMENTS

| | | |
|---|---|---|
| 855956 | 11/1952 | Fed. Rep. of Germany . |
| 577826 | 6/1946 | United Kingdom . |
| 199821 | 10/1967 | U.S.S.R. . |

OTHER PUBLICATIONS

Main, "Design and Measurement of Truer Running Wheels", Society of Automotive Engineers, 1968.

*Primary Examiner*—Frank T. Yost

*Attorney, Agent, or Firm*—Barnes, Kisselle, Raisch & Choate

[57] ABSTRACT

A pneumatic tire and wheel assembly wherein the wheel is manufactured with mounting holes offset from the geometric center to locate the low point of the first harmonic of radial runout adjacent a given angular location, such as the valve hole, so that, when a tire is mounted thereon with the high point of the first harmonic of radial force variation aligned with the valve hole, the respective harmonics cancel each other to provide a tire and wheel assembly with enhanced rotational characteristics.

In an apparatus for forming the wheel mounting holes by axially reciprocating a piercing tool against a wheel disc while the bead seats are clamped between wheel locating jaws, axially opposed jaw pairs are centered on an axis offset from the axis of reciprocation such that the centerline of the mounting holes is correspondingly eccentrically offset from the average bead seat axis.

8 Claims, 3 Drawing Figures

METHOD OF WHEEL MANUFACTURE FOR CORRECTING ROTATIONAL NON-UNIFORMITY OF A PNEUMATIC TIRE AND WHEEL ASSEMBLY

The present invention relates to methods and apparatus for wheel manufacture, and more particularly to correction of radial run out and radial force variations in a pneumatic tire and wheel assembly.

A problem long standing in the art lies in the production of pneumatic tires and wheels which, when assembled, will run true about their axis of rotation. Forces generated by any circumferential variation in the tire carcass or out-of-round conditions in the tire or wheel cause vibrations which, in turn, lead to dissatisfied customers and significant warranty claims against automobile manufacturers. The present trend among manufacturers toward higher tire inflation pressures and smaller vehicles to improve fuel economy accentuates the problem, so that uniformity in radial run out and force variation of the tire and wheel assembly has become more critical than in the past.

The state-of-the-art of wheel manufacture is such that wheels may now be produced with little variation in tire bead seat radius or radial run out. This has been accomplished by piercing the bolt mounting and center-pilot holes or openings in the wheel disc after the wheel disc and rim have been assembled and while the rim bead seats are clamped in fixed position coaxial with the piercing tool. However, tire manufacturers are not able to mass produce pneumatic tires of corresponding uniformity. Rather, production tires continue to exhibit substantial variation in radial force under dynamic conditions due to varying elasticity and thickness of the tire carcass, etc.

Recently, some auto manufacturers have begun spin- or dynamic-testing of each tire and wheel, determining the high and/or low points of the first harmonic of radial variation for the tire and the high and/or low points of the first harmonic of the average radial run out for the wheel, and then mounting the tire on the wheel so that the respective harmonics tend to cancel. This operation, termed "match mounting", manifestly is time consuming and expensive. Auto manufacturers have proposed that tire manufacturers dynamically test each tire and mark the tire carcass, such as on a side wall, at the location of the high (or low) point of the first harmonic of radial force variation. The problem remains, however, of matching tires so marked to the truer running wheels.

One object of the present invention is to provide a method of wheel manufacture and an apparatus for performing such method which will locate the low or high point of the first harmonic of bead-seat radial run out at a predetermined identifiable angular location on the wheel, and thereby eliminate the requirement in the "match mounting" technique previously discussed of testing each wheel individually. Another object of the invention is to tailor the amount of radial run out so located to a preselected nominal value which will substantially cancel the first harmonic of radial force variation in a production tire mounted wheel. A further object of the invention is to provide a method and apparatus for wheel manufacture which reduces the amount of eccentricity between the axis of the wheel center hole and the axis of the bolt circle.

Briefly described, the foregoing and other objects of the invention are accomplished by intentionally forming the bolt mounting and/or center-pilot openings in the wheel disc on an axis which is eccentrically offset from the average bead seat axis in a direction and by an amount predetermined to locate the low or high point of the first harmonic of bead seat radial run out circumferentialy adjacent a selected location in the wheel rim. In a preferred embodiment, the low point of the first harmonic of radial run out lies substantially within a quadrant centered about the valve hole in the rim. A tire having the location of the high point of the first harmonic of radial force variation marked thereon may then be assembled onto the wheel in accordance with the invention such that the respective tire and wheel harmonics are complementary and thereby tend to cancel each other.

Presently preferred embodiments of the invention, together with additional objects, features and advantages thereof, are set forth in the following description and illustrated in the accompanying drawings in which.

Figure 1:
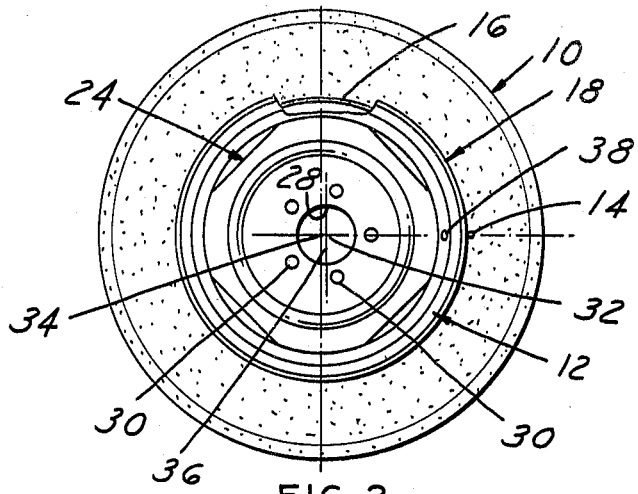
FIG. 1 is an elevational view of a pneumatic tire and wheel assembly constructed in accordance with the invention.

Referring to FIG. 1, a pneumatic tire 10 is pretested, i.e. prior to assembly onto wheel 12, for variations in radial force under dynamic operating conditions. Such testing may be accomplished by a tire manufacturer as previously described by mounting and inflating the tire on a test wheel structure, rotating the inflated tire against a load wheel, and measuring the amount and loci of the variation of radial force exerted by the tire. The circumferential location of a peak of the first harmonic of radial force variation, i.e. either the high or low point, is then identified by using conventional Fourier analysis techniques, and this location is marked as at 14 in FIG. 1 on the tire side wall near the tire bead 16. For the purpose of further discussion, it will be assumed that indicia 14 locates the high point of the first harmonic of radial force variation.

Wheel 12 includes a wheel rim 18 having the usual axially spaced bead seats 20,22 (FIG. 2) and a disc 24 carried internally of rim 18 for mounting the wheel to a vehicle. Disc 24 and rim 18 are separately manufactured to desired contour and then assembled to each other, with the disc 24 being permanently attached to the rim 18 as by press fit and welding or other joining methods. The particular rim and disc contours shown in the drawings are for illustrative purposes only and do not form part of the invention.

Figure 2:
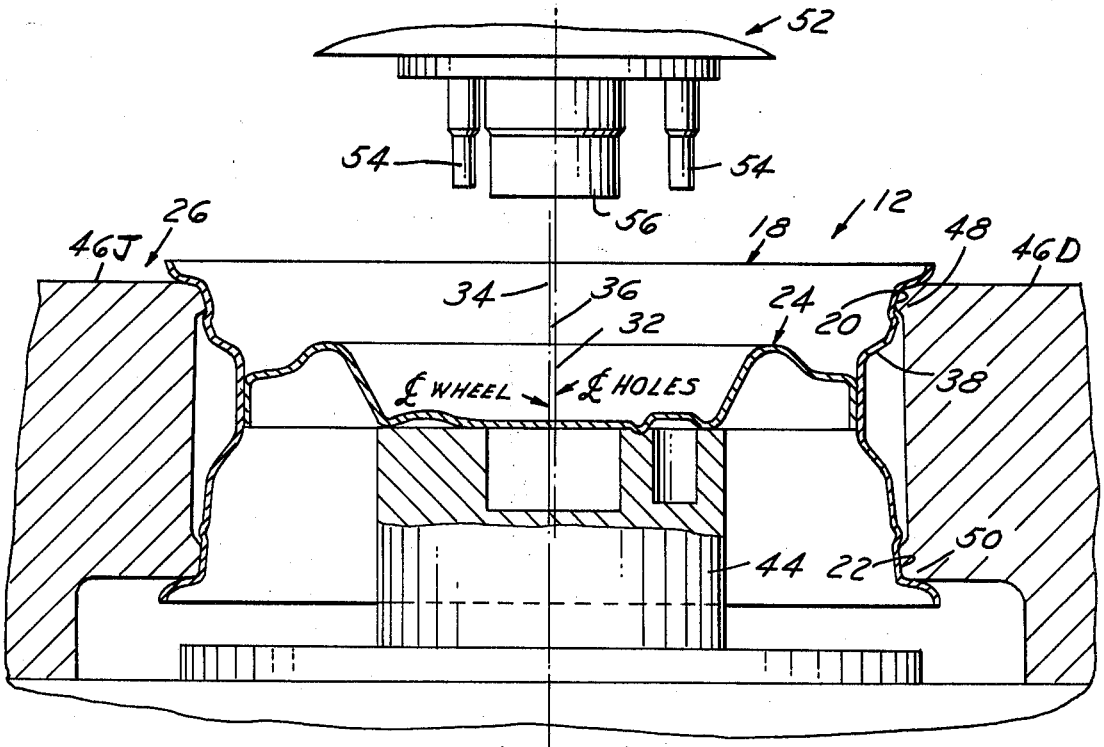
FIG. 2 is a side sectional view illustrating fabrication of the wheel in FIG. 1, and is generally taken along the line 2—2 in FIG. 3.
Figure 3:
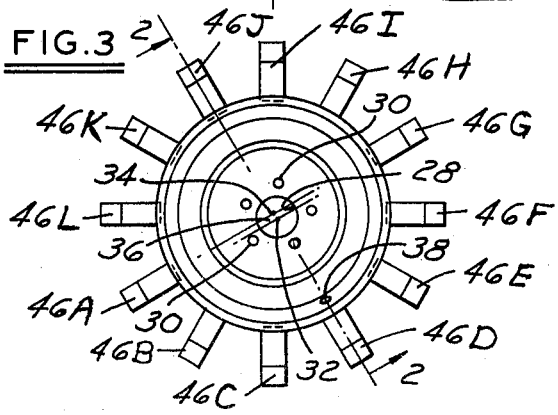
FIG. 3 is a schematic plan view of the tooling illustrated in FIG. 2 for fabrication of a wheel in accordance with the invention.

After the rim and disc have been assembled as described, the wheel 18 is placed in a die fixture 26 illustrated semi-schematically in FIGS. 2 and 3 for the purpose of forming the disc center pilot hole 28 and bolt holes 30. In accordance with the invention, the axial center line 32 of the center and/or bolt holes (preferably both) which pilot wheel 12 onto its vehicle mounting structure is eccentrically offset from the average centerline 34 of rim bead seats 20,22 by an amount 36 and in a direction empirically calculated to place the low point of the first harmonic of bead-seat radial run out adjacent a preselected location on the tire rim. Preferably, such low point is located substantially within the quadrant which includes the rim valve hole 38, i.e. within the range of about 45° on either side of the valve hole which provides a convenient point of reference on the wheel.

The foregoing is accomplished by placing wheel 12 into die 26 such that the central portion of disc 24 rests upon the die block 44. A plurality of radially reciprocable jaws 46 (FIG. 3), preferably twelve 46A–46L, are then closed against rim 18 until upper and lower contacts 48,50 on each jaw 46 engage respective bead seats 20,22. Preferably, wheel 12 is positioned such that valve hole 38 is located on a preselected jaw, i.e., jaw 46D in FIG. 3. Jaws 46A–46L thus firmly clamp wheel 12 to define bead seat average centerline 34. A punch assembly 52 having a central axis 32, a circular array of punches 54 for piercing and forming bolt holes 30 (FIGS. 1 and 3) and a center punch 56 for piercing and forming center pilot hole 28 is then lowered against the central portion of disc 24 to pierce and form the bolt and center holes.

To demonstrate operation of the invention, a wheel 12 was placed in die 26 and the jaws 46A–46L were individually adjusted from a nominal diameter of fourteen inches (for a fourteen-inch wheel) to positions indicated in the following table:

TABLE I

| | 46A | 46B | 46C | 46D | 46E | 46F | 46G | 46H | 46I | 46J | 46K | 46L |
|---|---|---|---|---|---|---|---|---|---|---|---|---|
| Contact 48 | 0 | 0 | −8 | −8 | −8 | 0 | 0 | 0 | +8 | +8 | +8 | 0 |
| Contact 50 | 0 | 0 | −8 | −8 | −8 | 0 | 0 | 0 | +8 | +8 | +8 | 0 |

wherein the numerals indicate displacement in thousandths of an inch of the respective contacts for each jaw, (−) toward the wheel center and (+) away from wheel center.

Note in particular in the above-described preferred mode of practicing the invention that opposed groups of one or more clamping jaws are offset with respect to the centerline of punch tooling 44,52 symmetrically of the valve hole. It is possible to accomplish this result on conventional wheel forming apparatus by radially shifting the axes of punch 52 and die 44. However, the clamping jaws are normally individually adjustable in commercially available wheel punching apparatus, while alignment between upper and lower punch tooling 52,44 is much more critical. Hence, it is preferred first to center all jaws on the axis of punch 52 and then physically shift the clamping position of approved groups of one or more jaws—i.e., jaws 46C–46E and 46I–46K—radially of the punch axis.

In two hundred wheels so manufactured, the average radial first harmonic measured from the axis of center pilot hole 28 was 0.014 inches with a standard deviation of 0.003 inches. The preferred range for this measurement is 0.005 to 0.020 inches. In 95% of the wheels, the low point of the first harmonic fell within an angular range of 60%. In 100% of the wheels, the low point fell within an 85% range between 350° and 75°, the valve hole being taken as 0°, all angles being measured counter-clockwise of the wheel in the orientation of FIG. 3. Average eccentricity between the bolt and pilot holes axes was 0.005 inches.

The foregoing demonstrates the principle of the invention which, although increasing average radial run out and the value of the first harmonic above levels that would otherwise be desirable, locates the harmonic low point adjacent a preselected point in the wheel rim, preferably the valve hole. When tire 10 is mounted thereon with high point mark 14 adjacent valve hole 38, the respective harmonics cancel each other in whole or in part. Manifestly, the high point of the radial run out first harmonic could as easily be located adjacent the valve hole, or at any other desired location on the wheel. Instead of using the valve hole as the visually identifiable locator for the predetermined harmonic low or high point, it is also feasible to mark the wheel rim in the hole-forming operation with suitable indicia to identify the center of the angular zone in which the harmonic low or high point is placed by the aforementioned pierce and coin tooling set up. In this connection, it will be appreciated that hole "forming" must be read in the broad sense as encompassing piercing and equivalent operations for providing the openings, including after-piercing operations such as forming or coining for finishing the openings.

The invention claimed is:

1. A method of constructing a tire and wheel assembly comprising the steps of:

(a) providing a wheel assembly comprising a rim with bead seats for mounting of a tire and a disc mounted internally of said rim;

(b) forming at least one opening in said disc for mounting said wheel to a vehicle with said opening being centered eccentrically of the average axis of said bead seats in a direction preselected nominally to locate a predetermined point in the first harmonic of radial runout of said wheel at a selected location circumferentially of said wheel; and (c) mounting on said wheel a tire which has been marked at a circumferential location on the tire corresponding to a predetermined point in the first harmonic of a radial characteristic of said tire opposite in phase to said predetermined point in said first harmonic of radial runout of said wheel such that said first harmonic of said tire complements said first harmonic of said wheel to provide a smoother running wheel and tire assembly.

2. The method set forth in claim 1 for mounting a tire which has been pretested for radial force variation wherein said tire is mounted on said wheel in said step (c) such that said first harmonic of radial run-out of said wheel complements the first harmonic radial force variation in said tire.

3. A method of constructing a tire and wheel assembly having improved rotational characteristics comprising the steps of:

(a) forming a wheel rim and disc assembly having tire bead seats on said rim and mounting opening means in said disc centered on an axis which is eccentrically offset with respect to the average axis of said bead seats by an amount predetermined to locate a peak in the first harmonic of radial runout of said wheel adjacent a preselected location on said wheel rim, and (b) mounting on said wheel rim bead seat a tire having indicia thereon indicative of a peak in the first harmonic of radial force variation of said tire opposite in phase to said peak of said first harmonic of radial runout, with said indicia on said tire being radially adjacent said preselected point on said wheel rim such tht said radial runout of said wheel tends to cancel said radial force variation in said tire to provide a smooth-running tire and wheel assembly.

4. The method set forth in claim 3 wherein said mounting openings in said disc are located eccentrically of said bead seats by an amount predetermined to locate said peak of radial runout substantially within a quadrant circumferentially of said wheel centered on said preselected location on said wheel rim.

5. The method set forth in claim 1 or 4 wherein said preselected location on said wheel rim comprises a valve stem opening.

6. The method set forth in claim 1 or 4 wherein said mounting openings in said disc are formed by placing said wheel in a die having a plurality of radially movable jaws adapted when closed to engage said bead seats and an axially reciprocable punch for forming said openings, closing said jaws firmly to clamp said bead seats such that said axis of said bead seats are offset from the central axis of said punch, and then reciprocating said punch against said disc so as to pierce said openings.

7. A method of improving rotational characteristics of a pneumatic tire and wheel assembly comprising the steps of:

(a) assembling a wheel comprising a rim having a substantially circular tire bead seat with a bead seat, (b) forming at least one disc opening in said assembled wheel for piloting said wheel onto a vehicle wheel mounting structure, with said at least one disc opening being formed on an axis which is offset from said bead seat axis by an amount and in a direction predetermined to locate a peak of the first harmonic of radial runout of said wheel circumferentially adjacent a selected location on said wheel rim, (c) providing a pneumatic tire having a first harmonic of radial force variation, (d) marking said tire at a circumferential location corresponding to a peak in said first harmonic of radial force variations opposite in phase to said peak of said first harmonic of radial runout, and (e) mounting said tire onto said wheel with said marked location on said tire substantially radially aligned with said selected locations on said wheel rim such that said first harmonic of radial runout and said first harmonic of radial force variation at least partially cancel each other.

8. A pneumatic tire and wheel assembly constructed in accordance with the method set forth in claim 1, 3 or 7.

* * * * *

UNITED STATES PATENT AND TRADEMARK OFFICE

CERTIFICATE OF CORRECTION

PATENT NO. : 4,279,287

DATED : July 21, 1981

INVENTOR(S) : Anwar Daudi et al

It is certified that error appears in the above–identified patent and that said Letters Patent are hereby corrected as shown below:

Column 3, line 55, "60%" should be -- 60° --

Column 3, line 56, "85%" should be -- 85° --

Signed and Sealed this

*Twenty-seventh* Day of *October 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,279,287

DATED : July 21, 1981

INVENTOR(S) : ANWAR DAUDI et al

It is certified that error appears in the above-identified patent and that said Letters Patent are hereby corrected as shown below:

In the claims:

Claim 7 at column 6, line 1, after "comprising" insert

-- a disc and --.

Claim 7 at column 6, line 2, cancel "bead seat with a".

Signed and Sealed this

*Eighth* Day of *March 1983*

[SEAL]

*Attest:*

GERALD J. MOSSINGHOFF

*Attesting Officer*

*Commissioner of Patents and Trademarks*